US007568428B2

(12) United States Patent
Reichel

(10) Patent No.: US 7,568,428 B2
(45) Date of Patent: Aug. 4, 2009

(54) PRESS CYLINDER AND METHOD FOR COMPENSATING THERMALLY INDUCED DEFORMATION OF A PRESS CYLINDER

(75) Inventor: Klaus T. Reichel, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 298 days.

(21) Appl. No.: 11/517,926

(22) Filed: Sep. 8, 2006

(65) Prior Publication Data

US 2007/0062405 A1 Mar. 22, 2007

(30) Foreign Application Priority Data

Sep. 10, 2005 (DE) ..... 10 2005 043 098

(51) Int. Cl.
*B41F 23/04* (2006.01)
*B41F 13/22* (2006.01)
*F28F 5/02* (2006.01)

(52) U.S. Cl. ..... 101/487; 492/46

(58) Field of Classification Search ..... 101/407.1, 101/487; 165/89, 90; 492/46
See application file for complete search history.

(56) References Cited

U.S. PATENT DOCUMENTS

| | | | | |
|---|---|---|---|---|
| 4,090,553 | A * | 5/1978 | Beghin | 164/448 |
| 4,252,184 | A * | 2/1981 | Appel | 165/90 |
| 4,593,744 | A * | 6/1986 | Lewin et al. | 164/448 |
| 5,404,936 | A * | 4/1995 | Niskanen et al. | 165/89 |
| 5,592,882 | A * | 1/1997 | Toyoda | 101/487 |
| 6,436,022 | B1 * | 8/2002 | Zaoralek | 492/46 |
| 6,688,223 | B1 * | 2/2004 | Dauner | 101/217 |
| 2007/0214988 | A1 * | 9/2007 | Becker et al. | 101/480 |

FOREIGN PATENT DOCUMENTS

| | | |
|---|---|---|
| DE | 199 57 943 | 6/2001 |
| DE | 102 50 686 | 5/2004 |
| DE | 20 2004 008 303 | 9/2004 |
| DE | 10 2004 054 031 | 5/2006 |
| EP | 0 557 245 | 8/1993 |
| EP | 0 574 103 | 12/1993 |

* cited by examiner

*Primary Examiner*—Anthony H Nguyen
*Assistant Examiner*—Leo T Hinze
(74) *Attorney, Agent, or Firm*—Cohen Pontani Lieberman & Pavane LLP

(57) ABSTRACT

A method for compensating for a thermally induced deformation of press cylinders which occurs during a printing operation in a well-defined circumferential area of the radially outer surface of the cylinder includes controlling the temperature of a well-defined circumferential area of the press cylinder to compensate for the deformation.

14 Claims, 6 Drawing Sheets

PRESS CYLINDER AND METHOD FOR COMPENSATING THERMALLY INDUCED DEFORMATION OF A PRESS CYLINDER

BACKGROUND OF THE INVENTION

1. Field of the Invention

The invention relates to a method for compensating for thermally induced deformation of a press cylinder. The invention also relates to a press cylinder having a base body with a radially outer surface and a temperature control means for compensating thermally induced deformation of the press cylinder.

2. Description of the Related Art

During a printing operation, thermally induced deformation can develop in the press cylinders of a printing press, especially on the outer surfaces of the cylinders, and this can have an adverse effect on the attainable printing result. This phenomenon can be observed especially in relatively long blanket cylinders of small diameter on which blankets or blanket plates are clamped in a lockup slot. In blanket cylinders of this type, thermally induced deformation of the press cylinder occurs in a circumferential area that is closer to the trailing edge than to the leading edge of the blanket. In the case of blanket cylinders, the maximum thermally induced deformation of the cylinder typically occurs in a circumferential area about 270° from the leading edge and thus about 90° from the trailing edge of the blanket. During the printing operation, the blanket cylinder heats up most strongly in this circumferential area, and this leads to deformation of the press cylinder.

Practical examples of press cylinders are already known in which the temperature can be controlled uniformly around the entire circumference in an area that lies radially inward from the outer surface of the cylinder. In press cylinders of this type, however, it is impossible to compensate effectively for thermally induced deformations of the cylinder.

SUMMARY OF THE INVENTION

An object of the present invention is to provide a method for compensating for thermally induced deformation of press cylinders and to develop a new type of press cylinder which allows for compensating for thermally induced deformation. The object is achieved by a method for compensating for a thermally induced deformation of a press cylinder of a printing press, the press cylinder having a radially outer circumferential surface, said method comprising independently controlling a temperature of a circumferential area of the press cylinder, the circumferential area being arranged between two longitudinal lines on the radially outer circumferential surface. According to the inventive method, the temperature of a well-defined circumferential area of the cylinder is controlled.

According to the present invention, the temperature of a well-defined circumferential area of the press cylinder is controlled to compensate for thermally induced deformation of the cylinder. This allows effective compensation of deformation of the press cylinder, and has a positive effect on the printing result.

The object of the invention is also met by a press cylinder having a base body that defines a radially outer surface, where an end piece is provided at both axial ends of the base body, and where the temperature of a well-defined circumferential area located radially inward from the surface of the base body can be controlled to compensate for thermally induced deformation of the cylinder.

According to one embodiment, the base body has a feed bore which extends in the axial direction to form an inlet for the admission of a temperature-control medium, and several discharge bores which extend in the axial direction to form an outlet for the discharge of the temperature-control medium. Some of the discharge bores can be blocked by an actuating element as a function of the circumferential position or angular position of the actuating element relative to the base body, so that the temperature-control medium can flow through only the one or more unblocked discharge bores and thus control the temperature of the well-defined circumferential area of the base body.

According to another embodiment of the invention, the base body has a cavity extending in the axial direction in which a flow control body is rotatably supported. The flow control body contains a feed bore which extends in the axial direction to form an inlet for the admission of a temperature-control medium, and several discharge bores which extend in the axial direction to form an outlet for the discharge of the temperature-control medium. The circumferential position or angular position of the flow control body relative to the base body of the cylinder determines the discharge bores through which the temperature-control medium can flow and thus control the temperature of the well-defined circumferential area of the base body.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
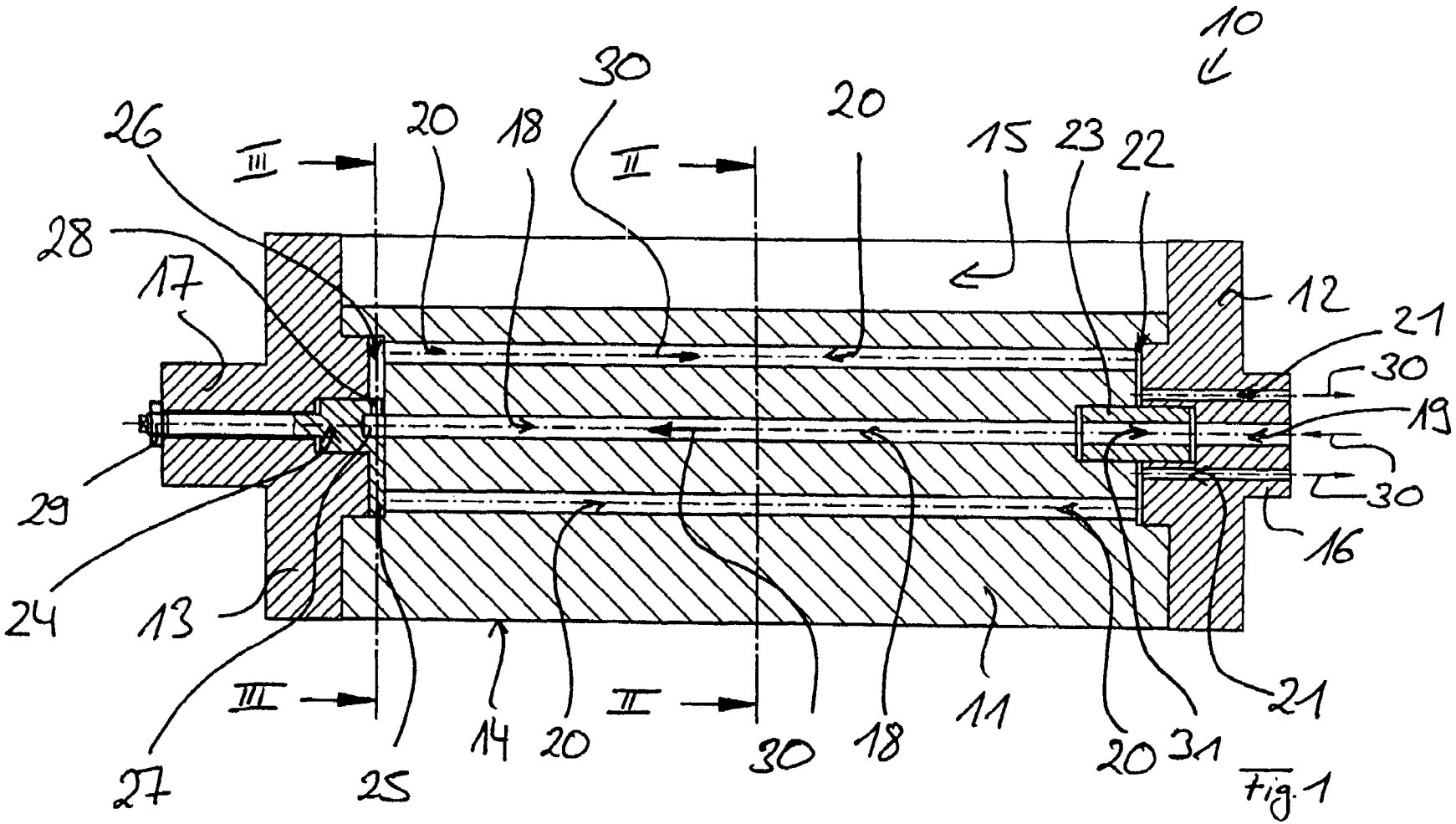
FIG. 1 is a schematic longitudinal cross sectional view through a first embodiment of the press cylinder of the invention.

FIG. 1 shows a first embodiment of a press cylinder 10 of the invention. The press cylinder 10 shown in FIG. 1 is a blanket cylinder. The press cylinder 10 has a base body 11, to which end pieces 12, 13 are attached, one at each end of the base body 11. The base body 11 defines an outer surface 14 of the press cylinder 10. At least one blanket can be clamped to this surface 14. This is accomplished using a lockup slot 15 in the base body 11. A clamping device (not shown) for the leading and trailing edges of the blanket to be clamped or of each blanket to be clamped is integrated in the lockup slot 15. The end pieces 12 and 13 have lateral journals 16 and 17, respectively, by which the press cylinder 10 can be rotatably supported in a press frame (not shown).

In the embodiment of FIGS. 1 to 4, a feed bore 18, which extends in the axial direction and forms an inlet for the admission of a temperature-control medium, is integrated into the base body 11. The feed bore 18 that is introduced into the base body 11 is extended by a corresponding feed bore 19 passing through the end piece 12. As shown in FIG. 1, the feed bore 18 is located approximately in the center of the base body 11, and the feed bore 19 is integrated approximately into the center of the end piece 12.

Figure 2:
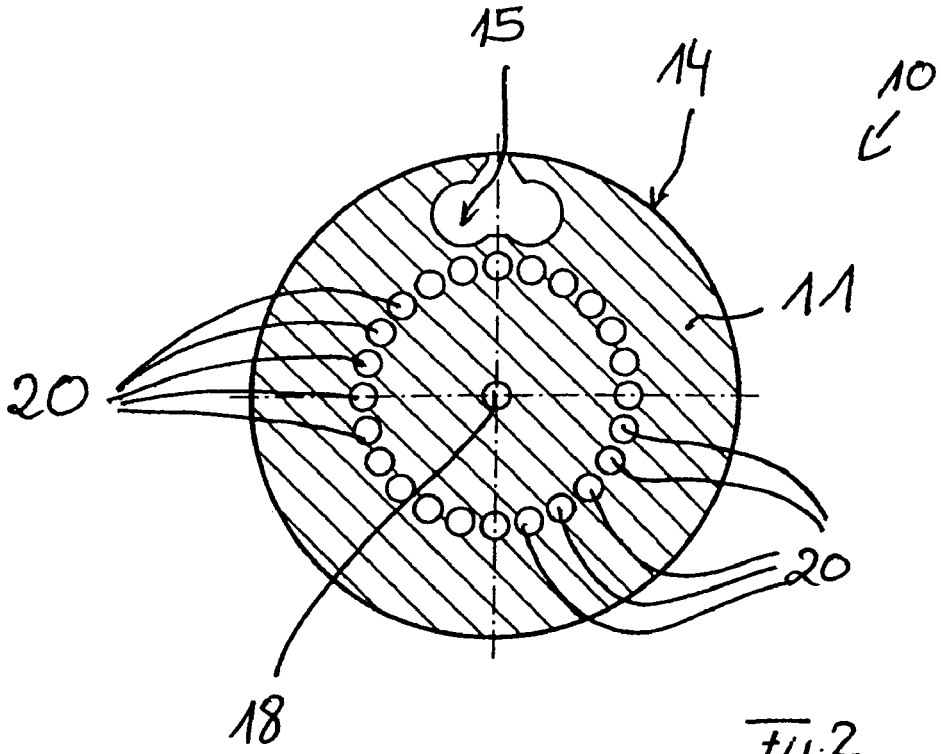
FIG. 2 is a cross sectional view through the press cylinder of the invention along sectional line II-II in FIG. 1.
Figure 3:
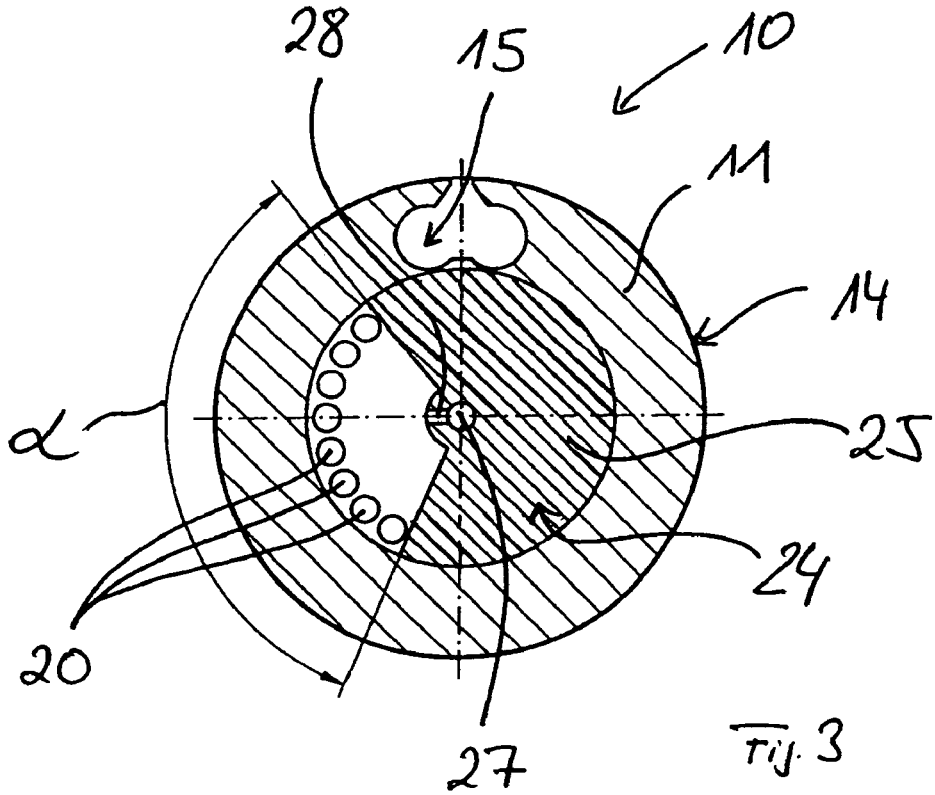
FIG. 3 is a cross sectional view through the press cylinder of the invention along sectional line III-III in FIG. 1.
Figure 4:
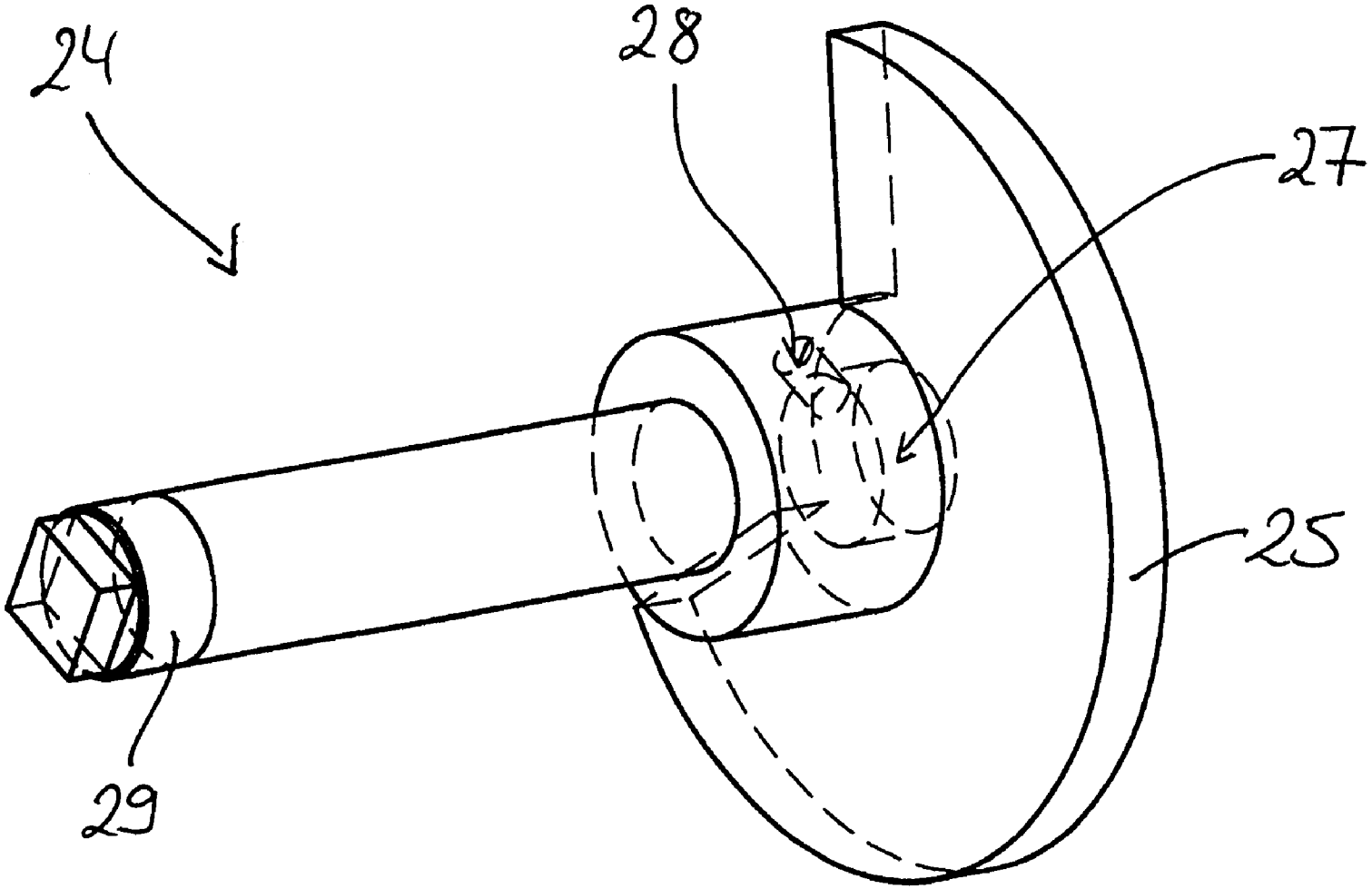
FIG. 4 is a perspective view of an actuating element of the press cylinder of the invention shown in FIG. 1.

Several discharge bores 20, which also extend in the axial direction, are also integrated into the base body 11. The discharge bores 20 are integrated into the base body 11 in locations which are offset in the radially outward direction from the feed bore 19. The discharge bores 20 are preferably integrated into the body 11 in a circular arrangement, as shown in FIG. 2. As previously mentioned, a feed bore 19 is integrated into one of the end pieces 12 and serves as an extension of the feed bore 18 in the base body 11. At least one discharge bore 21 is also provided in this end piece 12. Temperature-control medium conveyed through the press cylinder 10 can be removed from the cylinder through these discharge bores 21. The discharge bores 20 in the base body 11 communicate with the discharge bores 21 in the end piece 12 via a cavity 22, formed between the base body 11 and the end piece 12. A seal 23 extending through the cavity 22 seals the feed bore 18 of the base body 11 and the feed bore 19 of the end piece 12 off from this cavity 22.

An actuating element 24 is rotatably supported in the end piece 13, which is located at the opposite end of the cylinder from the end piece 12 containing the feed bore 19 and discharge bores 21. Some of the discharge bores 20 in the base body 11 can be blocked by the actuating element 24. Depending on the circumferential position or angular position of the actuating element 24 relative to the base body 11, some of the discharge bores 20 are blocked, while other discharge bores 20 remain unblocked (see FIG. 3). The temperature-control medium flows through the discharge bores 20 of the base body 11 that remain unblocked by the actuating element 24 and does not flow through the discharge bores 20 that are blocked.

The actuating element 24 has a cover piece 25 in the form of a segment of a circle, which covers or blocks some of the discharge bores 20 of the base body 11. The cover piece 25 is accommodated in a cavity 26, formed between the base body 11 and the end piece 13.

As is evident especially from FIG. 1, in the area of the actuating element 24, the feed bore 18 in the base body 11 is continued by a corresponding bore 27, which extends in the axial direction. A bore 28 extending in the radial direction allows the bore 27 to communicate with the cavity 26 and thus with the unblocked discharge bores 20 in the base body 11 that are not covered by the cover piece 25.

The embodiment of a press cylinder 10 of the invention that is illustrated in FIGS. 1 to 4 makes it possible to control the temperature of a well-defined circumferential area of the cylinder, namely, the circumferential area $\alpha$ (see FIG. 3), in which the discharge bores 20 of the base body 11 are not blocked or covered by the actuating element 24, so that temperature-control medium flows through them. This circumferential area $\alpha$ can be freely set or selected by appropriate rotation of the cover piece 25 of the actuating element 24 relative to the base body 11. For this purpose, an actuating section 29 of the actuating element 24 extends out from the end piece 13 of the press cylinder 10 and can thus be used to rotate the actuating element 24.

The direction of flow of the temperature-control medium in FIG. 1 is indicated by arrows 30. The temperature-control medium is introduced into the press cylinder 10 through the feed bore 19 in the end piece 12, through a bore 31 in the seal 23, and into the feed bore 18 in the base body 11. It then passes through the bores 27 and 28 of the actuating element 24 and enters the cavity 26 between the base body 11 and the end piece 13. From the cavity 26, the temperature-control medium then flows through the unblocked discharge bores 20 of the base body 11, through the cavity 22 between the body 11 and the end piece 12, and into the discharge bores 21 of the end piece 12, and is discharged in this way from the press cylinder 10.

FIGS. 5 to 8 show another embodiment of a press cylinder 32 of the invention, which also has a base body 33 and two end pieces 34 and 35. The base body 33 again defines a radially outer surface 36 of the press cylinder 32. A lockup slot 37 for clamping devices is again integrated into the base body 33. Blankets can be clamped onto the press cylinder 32 by these clamping devices. Lateral journals 38 and 39 on the end pieces 34 and 35 again allow the press cylinder 32 to be rotatably supported on a press frame.

Figure 5:
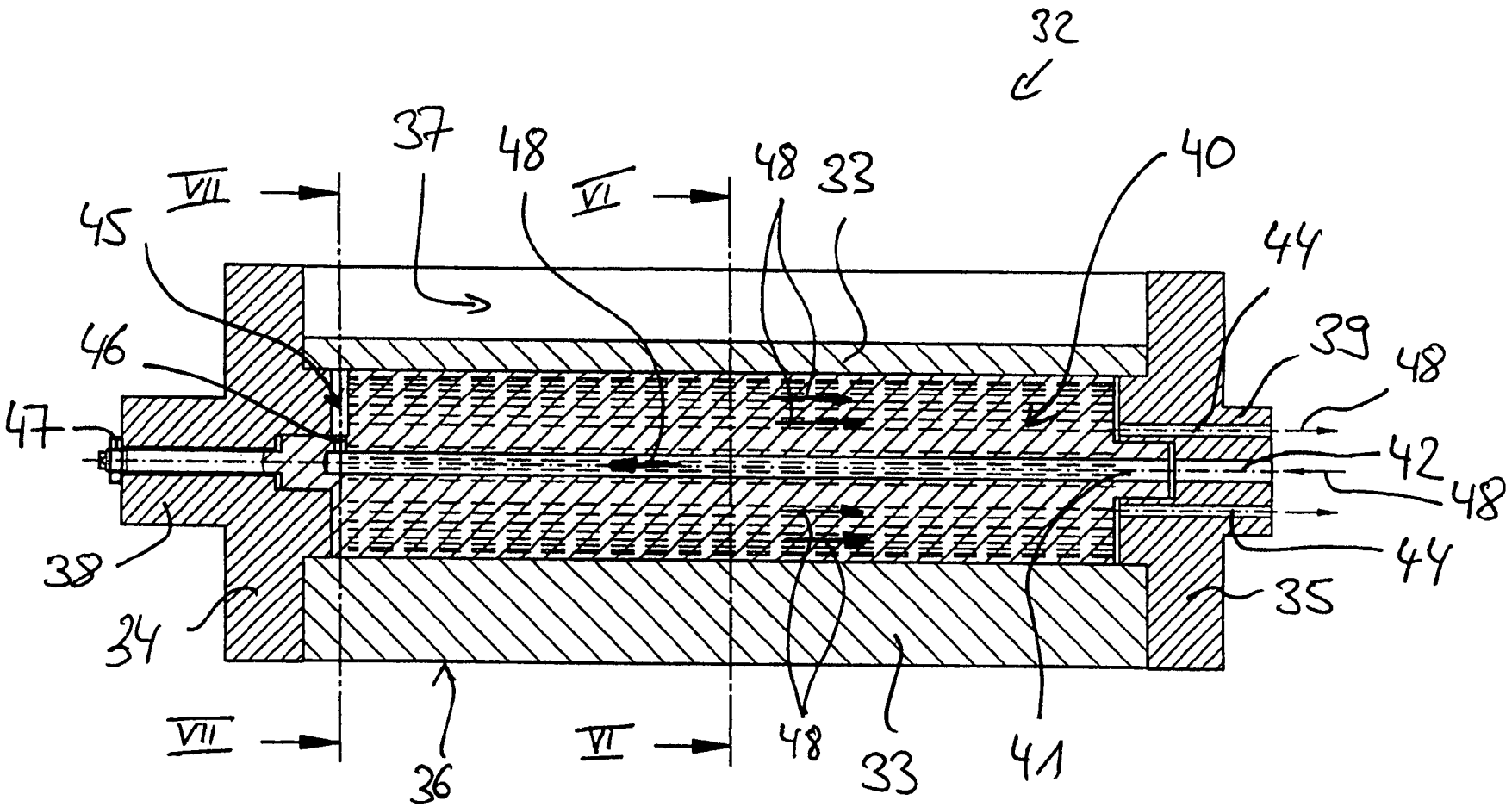
FIG. 5 is a schematic longitudinal cross sectional view through a second embodiment of the press cylinder of the invention.
Figure 6:
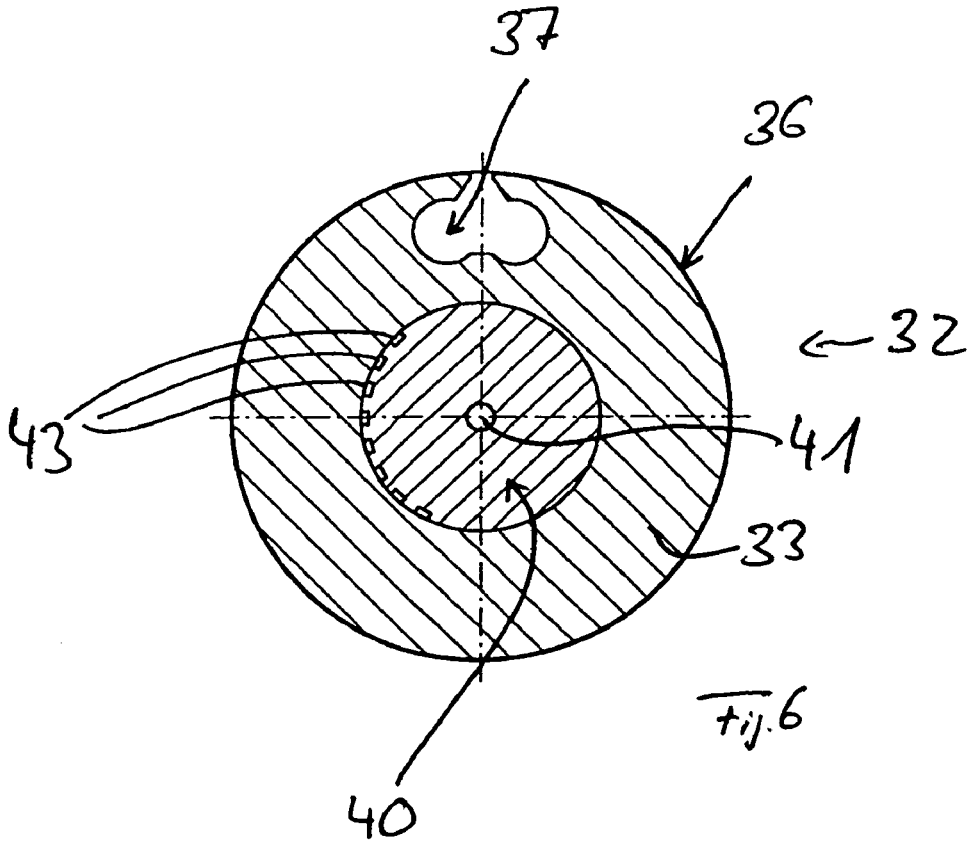
FIG. 6 is a cross sectional view through the press cylinder of the invention along sectional line VI-VI in FIG. 5.
Figure 7:
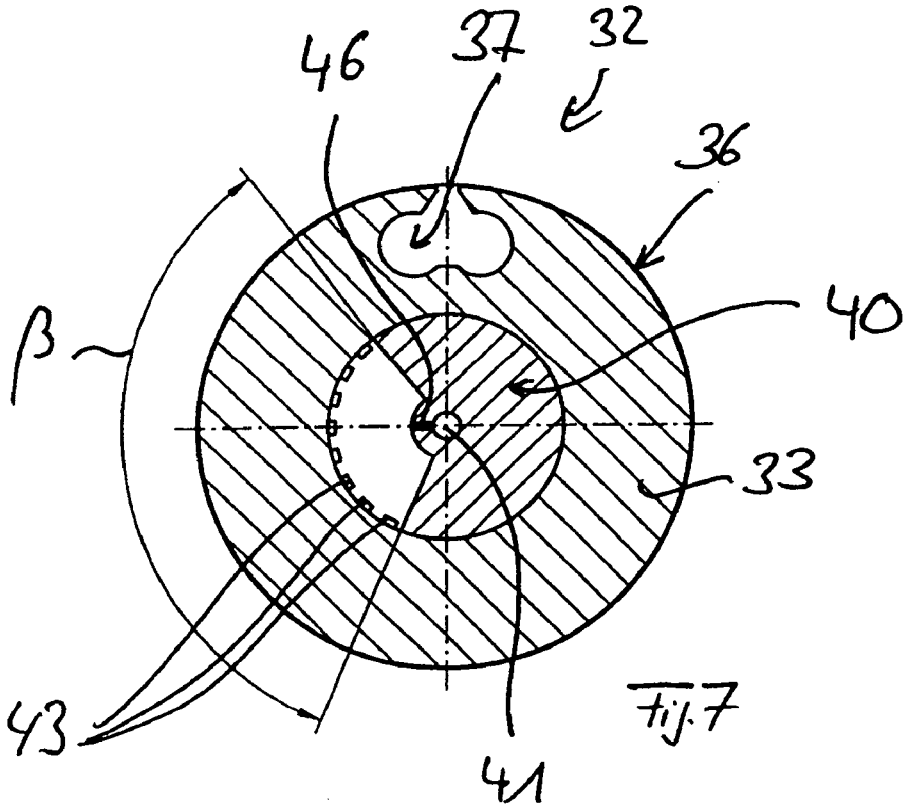
FIG. 7 is a cross sectional view through the press cylinder of the invention along sectional line VII-VII in FIG. 5.
Figure 8:
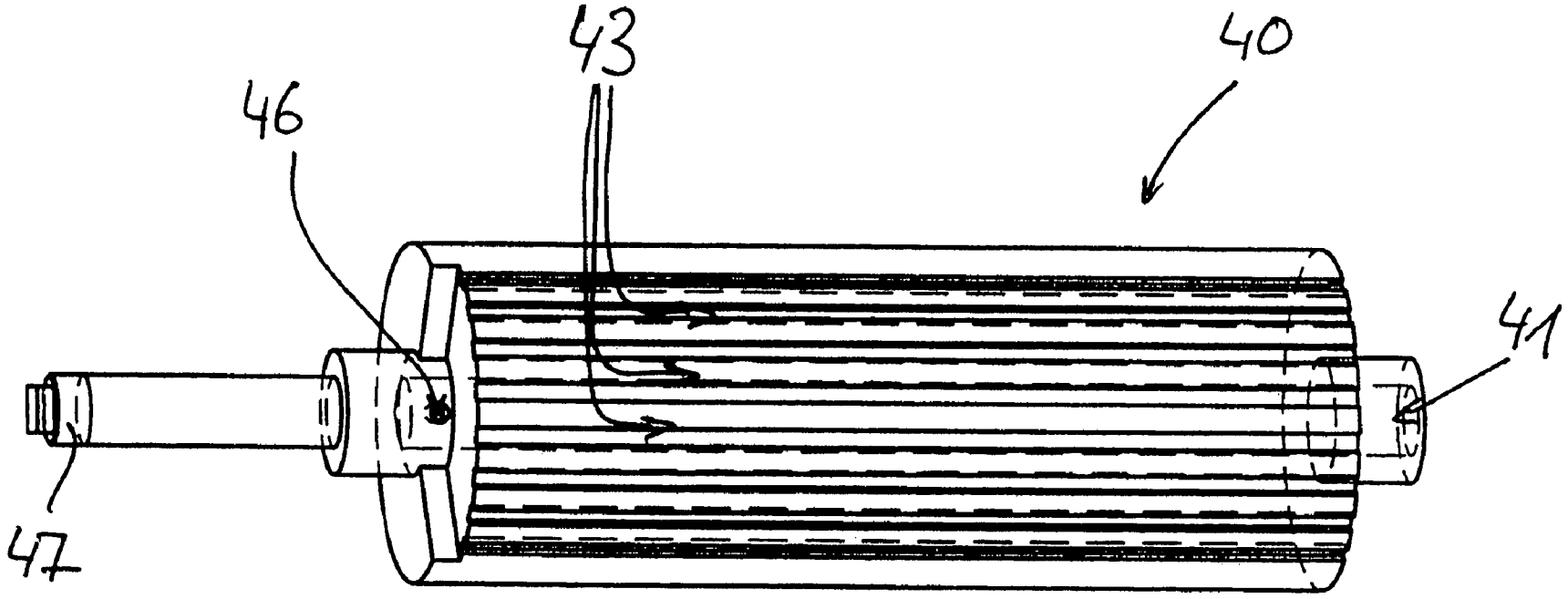
FIG. 8 is a perspective view of a flow control body of the press cylinder of the invention shown in FIG. 5.

In the embodiment of FIGS. 5 to 8, a cavity is integrated into the base body 33, and a displacer or flow control body 40 is installed in this cavity. A feed bore 41 is integrated into the flow control body 40. The feed bore 41 extends in the axial direction and is continued by a corresponding feed bore 42 in the end piece 35. In addition to the feed bore 41, which is located approximately in the center of the base body 33, several discharge bores 43 are provided in the base body 33. As shown in FIGS. 6 and 7, these discharge bores 43 (see FIGS. 6-8) are arranged in the form of a segment of a circle and extend over the angular area $\beta$ (FIG. 7) of the flow control body 40. In the end piece 35, the discharge bores 43 communicate with discharge bores 44 integrated into the end piece 35. In the end piece 34 at the other end, the discharge bores 43 open into a cavity 45, which is connected to the axial feed bore 41 of the flow control body 40 via a bore 46 that extends in the radial direction.

The flow control body 40 is rotatably supported in the cavity of the base body 33, so that the angular area $\beta$ of the flow control body 40 containing the discharge bores 43 can be rotated to any desired position relative to the base body 33. An actuating section 47 of the flow control body 40 extends out from the end piece 34 of the press cylinder 32 and is used to rotate the flow control body 40.

The temperature of the press cylinder 32 of the embodiment illustrated in FIGS. 5 to 8 can also be controlled in a well-defined circumferential area. For this purpose, the flow control body 40 is rotated relative to the body 33 of the press cylinder 32 into a circumferential position or angular position in which the discharge bores 43 are positioned in the circumferential area of the press cylinder 32 where the temperature is to be controlled. The temperature-control medium can be introduced into the feed bore 41 of the flow control body 40 through the feed bore 42. It enters the cavity 45 through the bore 46 and then enters the discharge bores 43 of the flow control body 40. It then enters the discharge bores 44 of the end piece 35 and is discharged from the press cylinder 32. In FIG. 5, the direction of flow is again visualized by arrows 48.

The method of the invention can be carried out with the embodiments of the press cylinders of the invention illustrated in FIGS. 1 to 8. In this method, thermally induced deformation of the outer surface of the press cylinder is compensated by controlling the temperature in a well-defined circumferential area of the cylinder. This is accomplished with a temperature-control medium, which is conveyed through an area of the press cylinder located a certain distance radially inside the outer surface of the cylinder.

In a first embodiment of the method of the invention, a well-defined circumferential area of the press cylinder is cooled. This circumferential area corresponds to at least part of the circumferential area in which the thermally induced deformation of the press cylinder to be compensated occurs. Alternatively, the press cylinder can be warmed or heated in a well-defined circumferential area located more or less diametrically opposite the circumferential area in which the deformation to be compensated occurs.

To accomplish this, it is merely necessary to rotate the actuating element 24 in the embodiment of FIGS. 1 to 4 or the flow control body 40 in the embodiment of FIGS. 5 to 8 relative to the body 11 or 33 of the press cylinder 10 or 32 and to convey a suitably cooled or heated temperature-control medium through the press cylinder.

Experiments and calculations have shown that thermally induced deformations of press cylinders can be effectively compensated by the invention. This improves the printing result that can be attained.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for compensating for a thermally induced deformation of a press cylinder of a printing press, the press cylinder having a radially outer circumferential surface, said method comprising independently controlling a temperature of a circumferential area of the press cylinder, the circumferential area being a partial circumferential area arranged between two longitudinal lines on the radially outer circumferential surface such that the circumferential area is less than an entire area of the radially outer circumferential surface, wherein the circumferential area in which the temperature is controlled rotates with the press cylinder.

2. The method of claim 1, wherein said step of controlling a temperature comprises cooling the press cylinder in the circumferential area, wherein the circumferential area corresponds at least partially to the area of the thermally induced deformation.

3. The method of claim 1, wherein said step of controlling a temperature comprises heating or warming the press cylinder in the circumferential area, wherein the circumferential area is arranged approximately diametrically opposite to the area of the thermally induced deformation.

4. A press cylinder of a printing press, comprising:

a base body defining a radially outer circumferential surface and having opposing axial ends;

two end pieces mounted at said opposing axial ends, respectively; and temperature control means arranged and dimensioned for independently controlling a temperature of a circumferential area of said press cylinder for compensating a thermally induced deformation of said press cylinder, said circumferential area being a partial circumferential area arranged circumferentially between two longitudinal lines on said radially outer circumferential surface such that said circumferential area is less than an entire area of said radially outer circumferential surface, wherein the circumferential area in which the temperature is controlled rotates with the press cylinder.

5. The press cylinder of claim 4, wherein said circumferential area corresponds at least partially to an area of the thermally induced deformation and said temperature control means is arranged and dimensioned for cooling said press cylinder in said circumferential area.

6. The press cylinder of claim 4, wherein said circumferential area is arranged approximately diametrically opposite to an area of the thermally induced deformation and said temperature control means is arranged and dimensioned for heating said press cylinder in said circumferential area.

7. The press cylinder of claim 4, wherein said temperature control means includes an axially extending feed bore defined in said base body and forming an inlet for the admission of a temperature-control medium and axially extending discharge bores defined in said base body and forming an outlet for the discharge of the temperature-control medium, said temperature control means comprising an actuating element arranged in said press cylinder and adjustable in one of a circumferential or angular position, said actuating element blocking some of said discharge bores, wherein at least one of said discharge bores is unblocked so that the temperature-control medium is allowed to flow through only said unblocked ones of said discharge bores to thereby control the temperature of press cylinder in said circumferential area.

8. The press cylinder of claim 7, wherein said feed bore extends approximately through a center of said base body and said discharge bores are arranged radially outward of said feed bore.

9. The press cylinder of claim 8, wherein said discharge bores are arranged in a circle.

10. The press cylinder of claim 7, wherein said actuating element is rotatably supported in one of said end pieces and comprises a cover piece forming a segment of a circle for blocking said some of said discharge bores, wherein the ones of said discharge bores that are blocked by said cover piece depends on an angular position of said actuating element.

11. The press cylinder of claim 4, wherein said base body defines an axially extending cavity, said temperature control means comprising a flow control body rotatably supported in said axially extending cavity, said flow control body defining an axially extending feed bore forming an inlet for the admission of a temperature-control medium and at least partially defining axially extending discharge bores forming an outlet for the discharge of the temperature-control medium, wherein a flow of the temperature-control medium through said discharge bores is controlled in response to an angular or circumferential position of said flow control body in said axially extending cavity for independently controlling the temperature of said circumferential area of said press cylinder.

12. The press cylinder of claim 11, wherein said feed bore extends approximately through a center of said press cylinder and said discharge bores are arranged at positions radially outward of said feed bore.

13. The press cylinder of claim 12, wherein said discharge bores are arranged on said flow control body in a circumferential area between two longitudinal lines on a radially outer surface of said flow control body.

14. The press cylinder of claim 13, wherein said flow control body is rotatably supported in said base body and wherein an angular position of said flow control body relative to said base body defines said circumferential area in which the temperature is controlled.

* * * * *